US009869531B1

(12) United States Patent
Zimmer

(10) Patent No.: US 9,869,531 B1
(45) Date of Patent: Jan. 16, 2018

(54) INTEGRATED OPTICAL SIGHT MOUNT

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 15/714,352

(22) Filed: Sep. 25, 2017

Related U.S. Application Data

(62) Division of application No. 15/272,372, filed on Sep. 21, 2016, now Pat. No. 9,797,687.

(60) Provisional application No. 62/221,704, filed on Sep. 22, 2015.

(51) Int. Cl.
*F41G 11/00* (2006.01)

(52) U.S. Cl.
CPC ..... *F41G 11/001* (2013.01)

(58) Field of Classification Search
CPC .... F41G 11/001; F41G 11/004; F41G 11/002; F41G 11/003
USPC ..... 42/123–127, 146, 90
See application file for complete search history.

(56) References Cited

U.S. PATENT DOCUMENTS

| | | | | |
|---|---|---|---|---|
| 4,418,487 | A | 12/1983 | Strahan | |
| 4,567,683 | A * | 2/1986 | Buehler | F41G 11/001 42/127 |
| 4,878,307 | A | 11/1989 | Singletary | |
| 5,107,612 | A | 4/1992 | Bechtel | |
| 7,194,836 | B1 | 3/2007 | Urban | |
| 8,393,108 | B1 | 3/2013 | Wilson | |
| 8,714,072 | B1 * | 5/2014 | Villarreal | F41G 3/165 42/130 |
| 2004/0211105 | A1 | 10/2004 | Arachequesne | |
| 2011/0131859 | A1 | 6/2011 | Lawson | |
| 2013/0180152 | A1 | 7/2013 | Speroni | |
| 2014/0157644 | A1 | 6/2014 | Jiminez et al. | |

OTHER PUBLICATIONS

ALG Defense, ALG 6-Second Mount—T1 [online], [retrieved on Sep. 21, 2016], Retrieved from the internet: <URL: http://algdefense.com/6-second-mount.html>.

ALG Defense, 6-Second Mount Installation Instructions [online], [dated Feb. 25, 2014], [retrieved on Sep. 21, 2016], Retrieved from the internet: <URL: https://d1z9d9wmo9i928.cloudfront.net/media/files/ALG_6_Second_Mount.pdf>.

* cited by examiner

*Primary Examiner* — Reginald S Tillman, Jr.
(74) *Attorney, Agent, or Firm* — Asgaard Patent Services, LLC; F. Wayne Thompson, Jr.

(57) ABSTRACT

Implementations of an integrated optical sight mount are provided. In some implementations, the optical sight mount may be integrated into the frame of a handgun via a locking block and used to position an optical sight over the slide thereof. In some implementations, the integrated optical sight mount may comprise a mounting platform that is supported by a first side wall and a second side wall, each of which extend from a locking block seated in the frame of the handgun. In some implementations, the mounting platform is configured for an optical gun sight to be secured thereon. In some implementations, the mounting platform and the side walls define an opening therebetween configured (e.g., dimensioned) so that the slide assembly of the handgun is able to pass therethrough without interference.

4 Claims, 16 Drawing Sheets

INTEGRATED OPTICAL SIGHT MOUNT

CROSS REFERENCE TO RELATED APPLICATION

This is a divisional application claiming the benefit of U.S. patent application Ser. No. 15/272,372, which was filed on Sep. 21, 2016, which claims the benefit of U.S. Patent Application Ser. No. 62/221,704, which was filed on Sep. 22, 2015, the entireties of both applications are incorporated herein by reference in their entirety.

TECHNICAL FIELD

This disclosure relates to implementations of an optical sight mount for use with a handgun, and more particularly, to optical sight mounts that are integrated into the frame of a handgun.

BACKGROUND

In general, pistols come from the factory with iron sights. Typical iron sights provided on a pistol include a front post and a rear notch which must be aligned to aim the pistol.

Mounting an optical sight (e.g., a reflex type sight) on a pistol offers a shooter several advantages over using iron sights alone. First, reflex type sights provide a simple sight picture comprised of a single illuminated aiming point in place of the front post and rear notch of iron sights. In this way, a shooter's accuracy and/or speed with a pistol may improve. Second, a shooter may be able to aim with the illuminated aiming point of an optical sight in environmental conditions that would make visual alignment of the iron sights difficult or impossible, low light conditions for example.

However, given the design of most pistols, attaching an optical sight may be difficult to do. In order to accommodate an optical sight, the slide of the pistol may need to be permanently modified (e.g., milled) in order to receive an optical sight thereon. If the user decides to switch to a new model of optical sight, further modifications to the pistol may be required. In some instances, the pistol may not be suitable for further modification.

Mounting an optical sight directly to the slide of a pistol can have several disadvantages. First, the slide of the pistol may be weakened from machining a pocket therein for the optical sight. Second, the rapid acceleration and deceleration of the slide during operation (e.g., firing) will place forces (e.g., longitudinal forces) on the optical sight that may reduce its service life. Third, the optical sight adds additional mass to the slide which may affect the reliable operation of the pistol. For example, the action of the pistol may be unable to reliably lock or unlock as a result of the additional mass on the slide.

Accordingly, it can be seen that needs exist for continuing improvement in optical sight mounts. It is to the provision of an optical sight mount that may be integrated into the frame of a handgun that the present invention is primarily directed.

SUMMARY OF THE INVENTION

Implementations of an integrated optical sight mount are provided. In some implementations, the optical sight mount may be integrated into the frame of a handgun and be an integral portion thereof. Optical sights such as the Trijicon® RMR, for example, may be mounted to the integrated optical sight mount and thereby used to aim the handgun.

In some implementations, the integrated optical sight mount may comprise a mounting platform that is supported by a first side wall and a second side wall, each of which extend from the frame of a handgun. In some implementations, the mounting platform may be configured for an optical sight to be secured thereon.

In some implementations, the mounting platform and the side walls define an opening therebetween. In some implementations, the opening is configured (e.g., dimensioned) so that the slide assembly (e.g., the slide, barrel, and recoil spring assembly) of the handgun is able to pass therethrough. In this way, the integrated optical sight mount does not interfere with the assembly or disassembly of the handgun, and the slide is able to reciprocate when the handgun is fired or otherwise manipulated.

In some implementations, the mounting platform and the side walls of the integrated optical sight mount may be a single unitary piece.

In some implementations, the mounting platform may be removably secured between the side walls of an integrated optical sight mount. Through the use of interchangeable mounting platforms constructed to receive optical sights thereon, a user may change the optical sight mounted on a handgun by changing mounting platforms. In this way, modification of the handgun is not required in order to accommodate a variety of optical sights. In some implementations, the mounting platform may be removed without the need to remove the optical sight therefrom.

In some implementations, the side walls may be positioned on the frame of the handgun to place the mounting platform and an attached optical sight over the ejection port of the slide.

In some implementations, the side walls may be positioned on the frame of the handgun to place the mounting platform and an attached optical sight over the rear end of the slide assembly.

In some implementations, the integrated optical sight mount may further comprise a locking block. In this way, the optical sight mount may be integrated into the handgun by installing the locking block in the frame thereof. In some implementations, the locking block may be used to lock the barrel to the slide of a handgun. In this way, a loaded cartridge may be fired from a stable chamber.

DETAILED DESCRIPTION

Figure 1A:
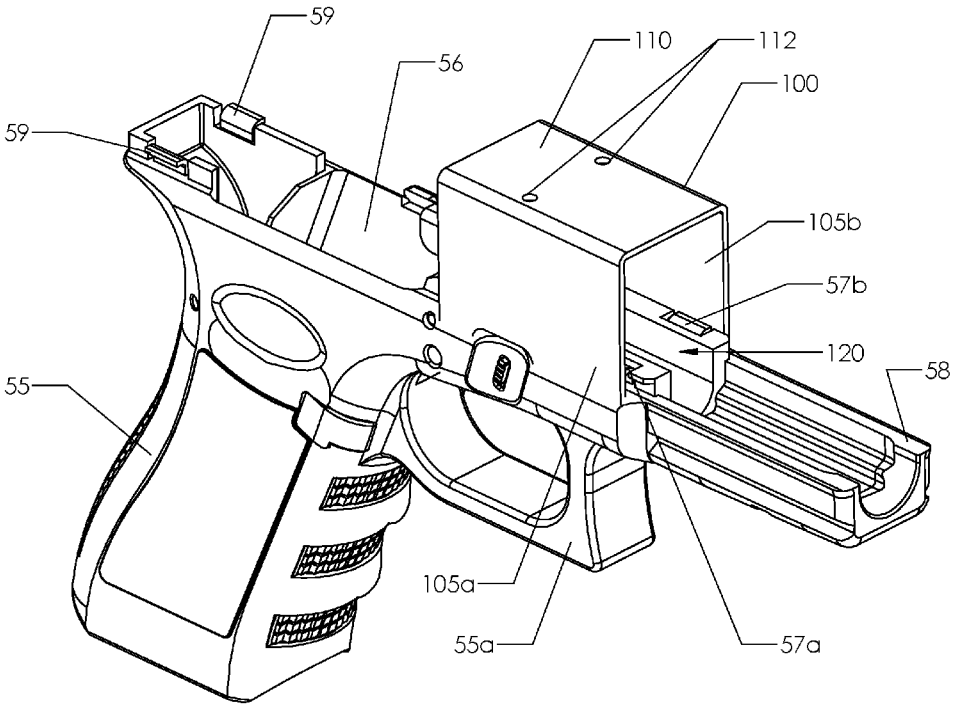
FIG. 1A illustrates an isometric view of an optical sight mount that has been integrated into the frame of a handgun according to the principles of the present disclosure.

FIGS. 1A-1G illustrate an example integrated optical sight mount 100 according to the principles of the present disclosure. In some implementations, the optical sight mount 100 may be integrated into the frame 55 of a handgun 50 and used to position an optical sight 30 over the slide 62 thereof (see, e.g., FIGS. 1A and 1E).

As shown in FIG. 1A, in some implementations, the frame 55 of the handgun 50 may comprise a magazine well 56, dust cover 58, front guide rails 57, rear guide rails 59, and a trigger guard 55*a*.

Figure 1B:
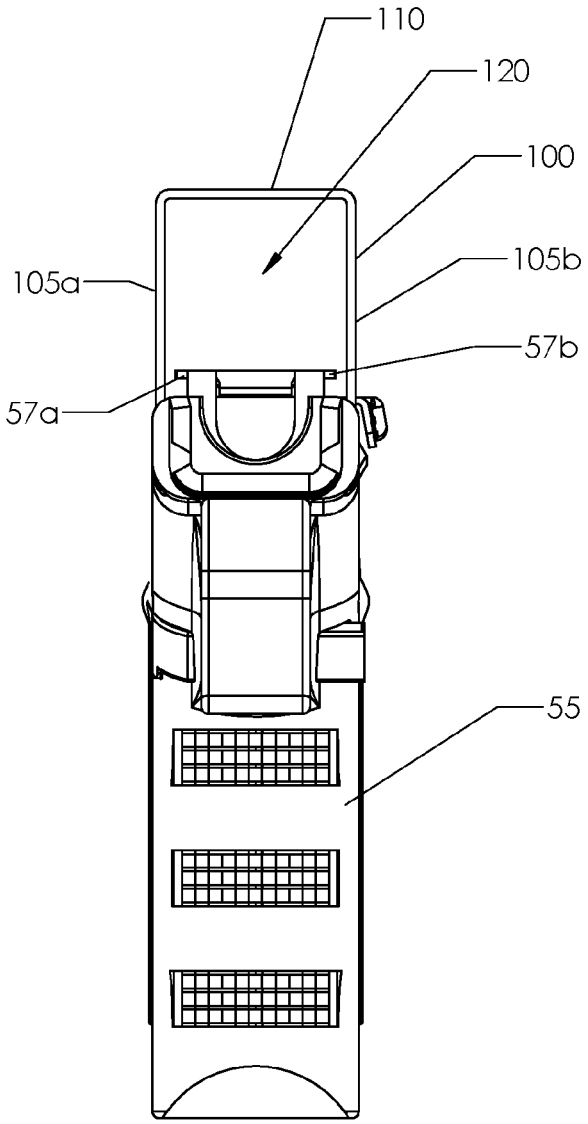
FIG. 1B illustrates a front view of the integrated optical sight mount shown in FIG. 1A.
Figure 1C:
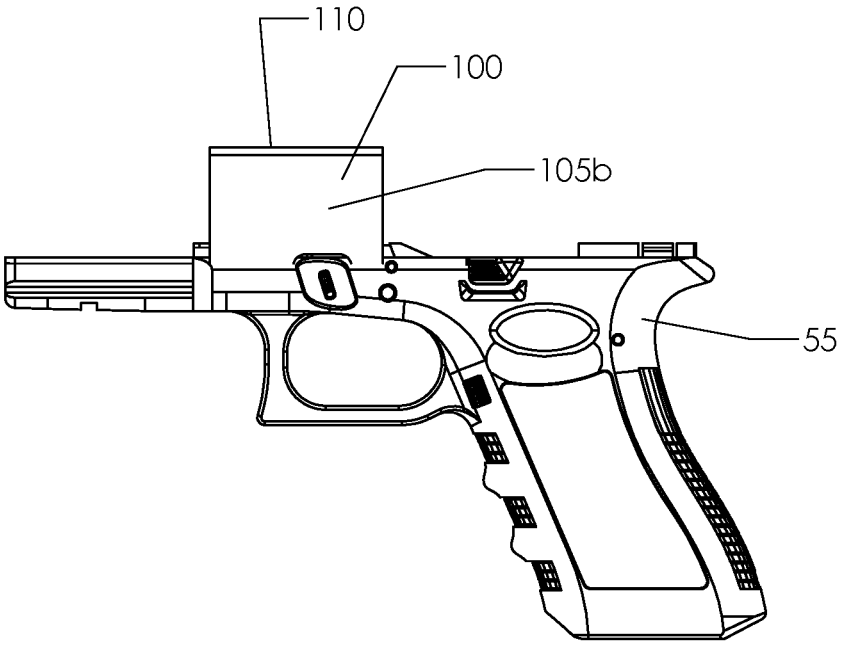
FIG. 1C illustrates a left side view of the integrated optical sight mount shown in FIG. 1A.
Figure 1D:
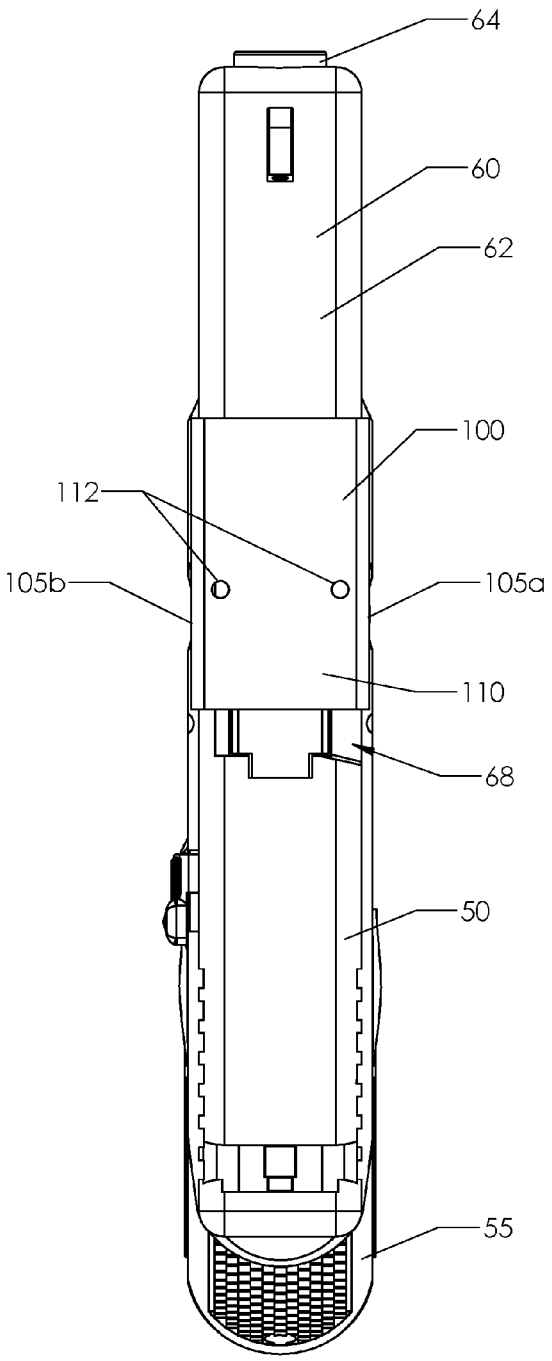
FIG. 1D illustrates a top view of the integrated optical sight mount shown in FIG. 1A, having a slide assembly installed thereon.
Figure 1E:
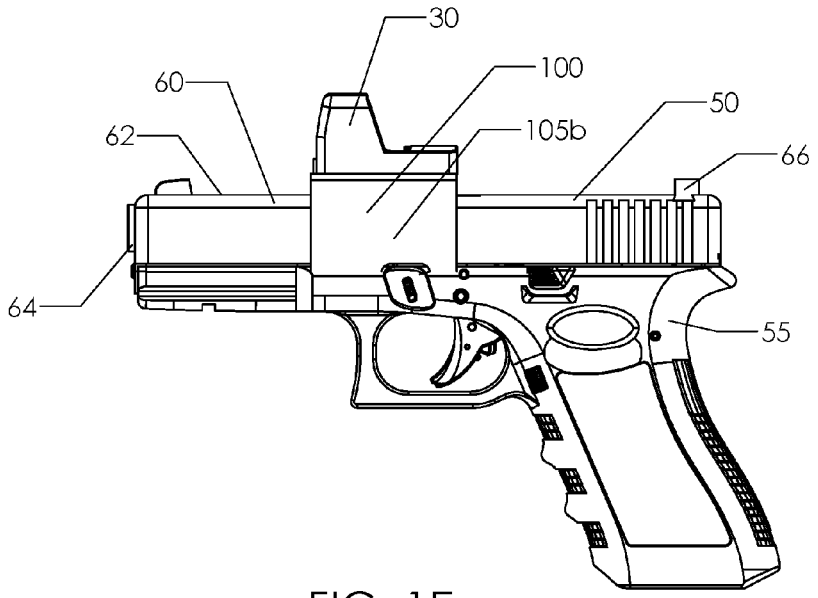
FIG. 1E illustrates a left side view of the integrated optical sight mount shown in FIG. 1D, having an optical sight installed thereon.
Figure 1F:
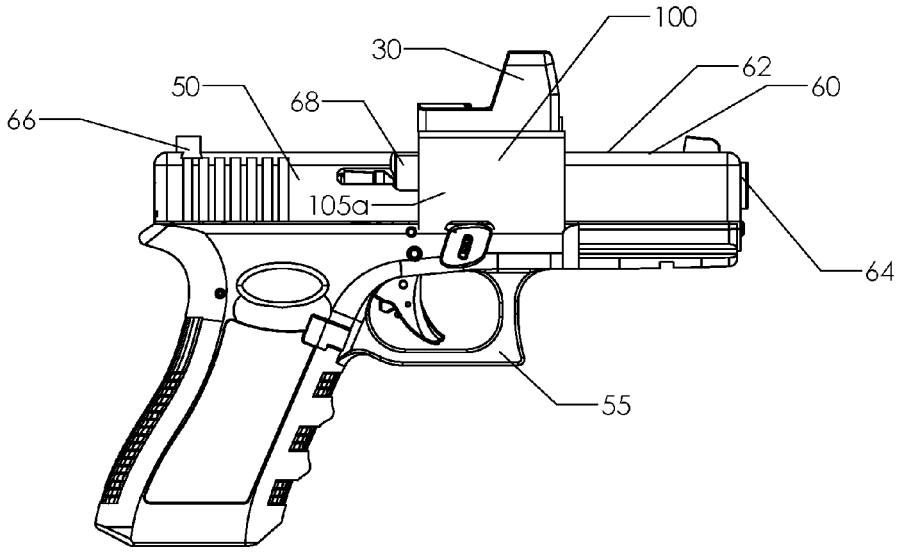
FIG. 1F illustrates a right side view of the integrated optical sight mount shown in FIG. 1D, having an optical sight installed thereon.
Figure 1G:
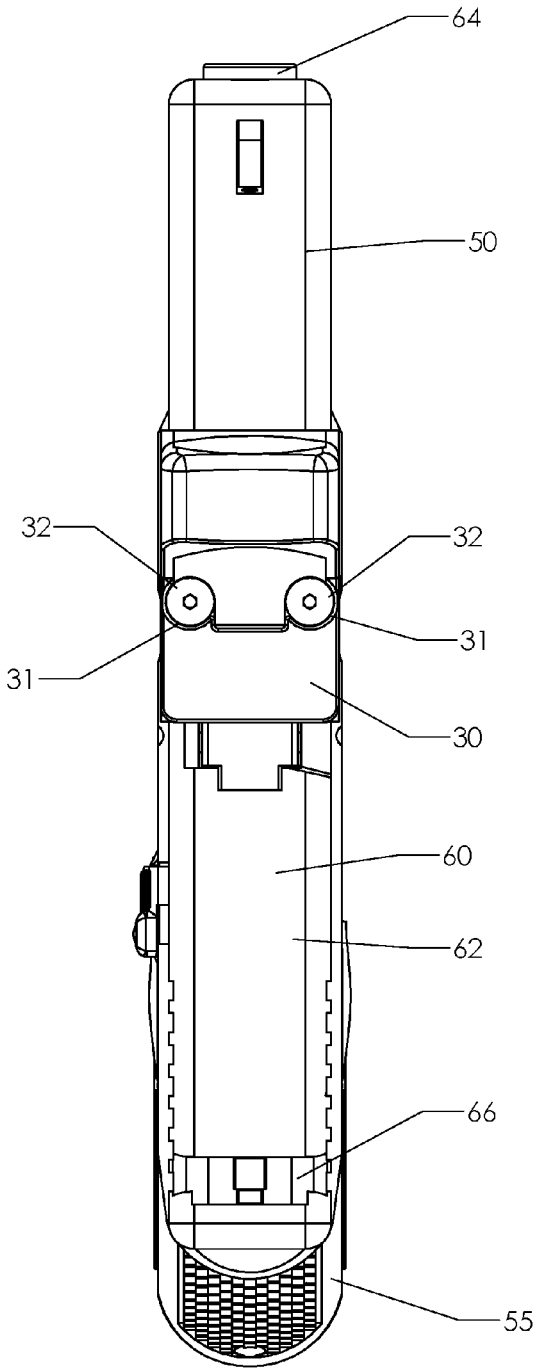
FIG. 1G illustrates a top view of the integrated optical sight mount shown in FIGS. 1E and 1F.

Optical sights 30 such as the Trijicon® RMR, for example, may be mounted on the integrated optical sight mount 100 and thereby used to aim the handgun 50 (see, e.g., FIG. 1F). In some implementations, the optical sight 30 may be an Aimpoint® Micro optical sight, a DOCTER® red dot sight, a Leupold® Deltapoint, or other similarly sized optical sights that are currently known or developed in the future.

As shown in FIG. 1A, in some implementations, the integrated optical sight mount 100 may comprise a mounting platform 110 that is supported by a first side wall 105*a* and a second side wall 105*b* (collectively side walls 105), each of which extend from the frame 55 of a handgun 50. In some implementations, the mounting platform 110 may be configured for an optical sight 30 to be secured thereon (see, e.g., FIG. 1E).

As shown in FIG. 1B, in some implementations, the mounting platform 110 and the side walls 105 define an opening 120 therebetween. In some implementations, the opening 120 is configured (e.g., dimensioned) so that the slide assembly 60 (e.g., the slide 62, barrel 64, and recoil spring assembly) of the handgun 50 is able to pass therethrough (see, e.g., FIG. 1D). In this way, the integrated optical sight mount 100 does not interfere with the assembly or disassembly of the handgun 50, and the slide 62 is able to reciprocate when the handgun 50 is fired or otherwise manipulated.

As shown in FIG. 1A, in some implementations, the mounting platform 110 and the side walls 105 of the integrated optical sight mount 100 may be a single unitary piece.

Figure 2A:
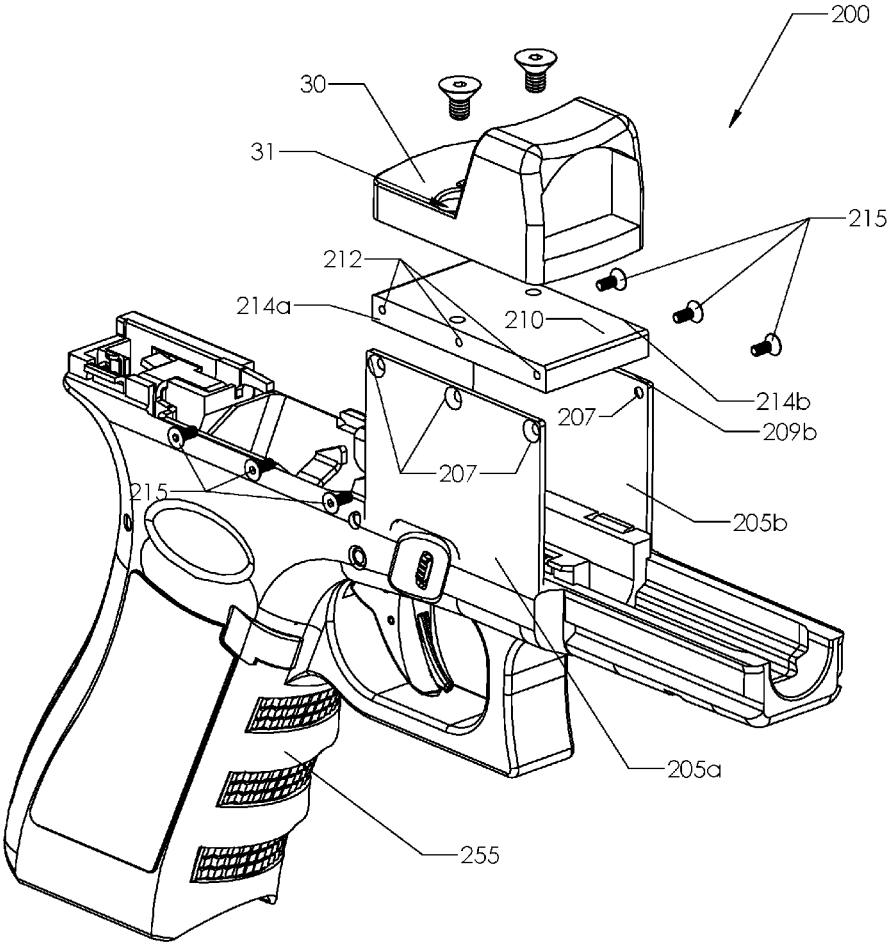
FIGS. 2A and 2B illustrate another example implementation of an optical sight mount that has been integrated into the frame of a handgun according to the principles of the present disclosure.

As shown in FIG. 2A, in some implementations, the mounting platform 210 may be removably attached to the side walls 205 of an integrated optical sight mount 200 (discussed in detail below).

As shown in FIG. 1B, in some implementations, the first side wall 105*a* and the second side wall 105*b* extend from the first side and the second side, respectively, of the handgun frame 55 and are parallel, or substantially parallel, to each other. In some implementations, the first side wall 105*a* and the second side wall 105*b* may be positioned adjacent the first front guide rail 57*a* and the second front guide rail 57*b*, respectively, of the handgun frame 55 (see, e.g., FIG. 1A). In some implementations, a gap may extend between the interior side of the first side wall 105*a* and the first front guide rail 57*a* and between the interior side of the second side wall 105*b* and the second front guide rail 57*b* (see, e.g., FIG. 1B). In this way, the side walls 105 do not prevent the slide 62 from interfacing with, and sliding, on the front guide rails 57*a*, 57*b* of the handgun frame 55 (see, e.g., FIG. 1D). In some implementations, the side walls 105 may be positioned to place the mounting platform 110 and the attached optical sight 30 over the ejection port 68 of the slide 62 (see, e.g., FIG. 1D).

As shown in FIG. 1A, in some implementations, the mounting platform 110 may extend between the first side wall 105*a* and the second side wall 105*b*. In some implementations, the mounting platform 110 may have the general shape of a rectangle. In some implementations, the mounting platform 110 may be any shape suitable for mounting an optical sight 30 thereon. In some implementations, mounting platform 110 may include two threaded openings 112 therein. In this way, an optical sight 30 may be secured to the mounting platform 110 using screws 32 or other threaded fasteners (see, e.g., FIG. 1G).

As shown in FIG. 1B, in some implementations, the top surface of the mounting platform 110 may be at a perpendicular angle relative to the side walls 105. In some implementations, the top side of the mounting platform 110 may be flat. In some implementations, the top side of the mounting platform 110 may have a relief therein configured to receive at least a portion of an optical sight (e.g., an Aimpoint® Micro optical sight) therein. In some implementations, the top side of the mounting platform 110 may be configured (e.g., contoured) to interface with the mount compatible surface (e.g., the bottom side) of an optical sight 30.

In some implementations, the mounting platform 110 may have more than two (e.g., four) threaded openings 112 therein. In some implementations, the openings 112 may not be threaded. In some implementations, the threaded openings 112 may be positioned on the mounting platform 110 in any configuration suitable for using one or more threaded fasteners to secure an optical sight 30 thereon.

In some implementations, the top side of the mounting platform 110 may include a recoil lug thereon (not shown). In this way, an attached optical sight 30 may be prevented from sliding back and forth due to the incidental vibrations associated with the discharge of a firearm.

In some implementations, an optical sight 30 (e.g., the Trijicon® RMR shown in FIG. 1F) may be secured to the mounting platform 110 of an optical sight mount 100 using the following steps:

Initially, orient the optical sight 30 so that the two openings 31 extending therethrough are aligned with the two threaded openings 112 in the mounting platform 110. Then, insert a screw 32 through each opening 31 of the optical sight 30 and threadedly secure it into the aligned threaded opening 112 of the mounting platform 110 (see, e.g., FIG. 1G). In this way, the screws 32 are used to secure the optical sight 30 to the mounting platform 110.

To remove an optical sight 30 from the integrated optical sight mount 100, the above steps may be performed in reverse.

An optical sight 30 (e.g., an Aimpoint® Micro) having threaded openings on a bottom side thereof may be secured (i.e., attached) to the mounting platform 110 of an optical sight 100 using the following steps:

Initially, orient the optical sight 30 so that the threaded openings located on the bottom side of the optical sight 30 are aligned with the openings 112 of the mounting platform 110. Then, insert a screw through each opening 112 of the mounting platform 110 from a bottom side thereof and threadedly secure it into the aligned openings of the optical sight 30. In this way, the screws are used to secure the optical sight 30 to the mounting platform 110.

In some implementations, the integrated optical sight mount 100 may be formed from the same material(s) as the handgun frame 55 from which it extends. In some implementations, the integrated optical sight mount 100 may be formed from a polymer (e.g., plastic). In some implementations, the integrated optical sight mount 100 may be formed from a metal (e.g., aluminum, steel, and/or titanium). In some implementations, the integrated optical sight mount 100 may be formed from a combination of materials.

Figure 2B:
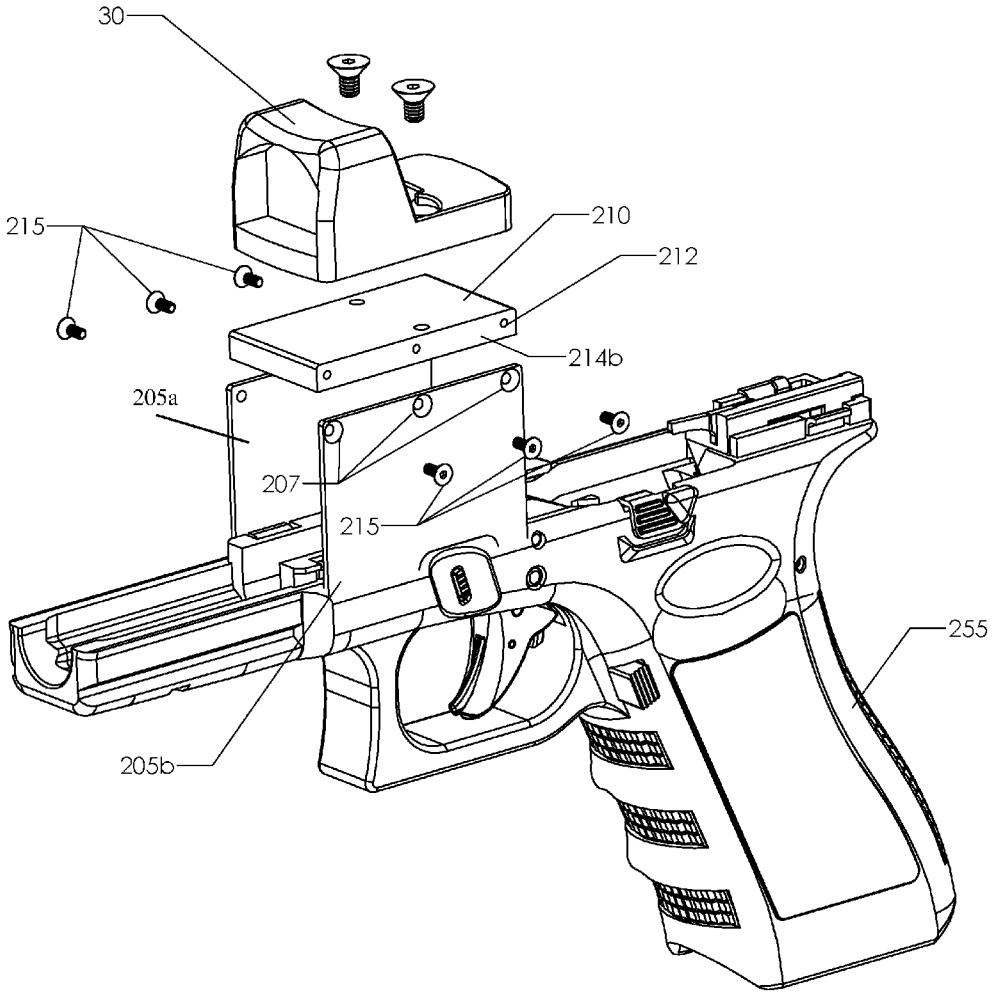

FIGS. 2A and 2B illustrate another example implementation of an integrated optical sight mount 200 in accordance with the present disclosure. In some implementations, the integrated optical sight mount 200 is similar to the integrated optical sight mount 100 discussed above but includes a removable mounting platform 210. Through the use of interchangeable mounting platforms 210 constructed to receive optical sights thereon, a user may change the optical sight mounted to the handgun frame 255 by changing mounting platforms 210. In this way, modification of the handgun is not required in order to accommodate a variety of optical sights.

As shown in FIGS. 2A and 2B, in some implementations, the mounting platform 210 may be removably secured between the first side wall 205*a* and second side wall 205*b* of the integrated optical sight mount 200 by threaded fasteners.

In some implementations, as shown in FIGS. 2A and 2B, there may be three openings 207 positioned adjacent the top side 209*a* of the first side wall 205*a* and the top side 209*b* of the second side wall 205*b*. Each of the openings 207 may be configured to receive a screw 215, or similar fastener, therein. In some implementations, each side wall 205*a*, 205*b* may include more than three or less than three openings 207 therethrough.

In some implementations, as shown in FIGS. 2A and 2B, both a first side 214*a* and a second side 214*b* of the mounting platform 210 may include three openings 212 therein. Each opening 212 is configured to threadedly receive a screw 215 therein. In some implementations, the first side 214*a* and the second side 214*b* of the mounting platform 210 may include more than three openings or less than three openings therein.

To assemble the integrated optical sight mount 200 constructed in accordance with the present disclosure, in some implementations, the openings 207 through the first side wall 205*a* and second side wall 205*b* may be aligned with the openings 212 of the first side 214*a* and the second side 214*b*, respectively, of the mounting platform 210. Then, a screw 215 is inserted through each opening 207 of a side wall 205 and threadedly secured into the aligned opening 212 of the mounting platform 210. Next, the user may secure an optical sight 30 of their choice to the mounting platform 210.

To disassemble the integrated optical sight mount 200, the above steps may be performed in reverse without the need to remove the optical sight 30 from the mounting platform 210.

Figure 3A:
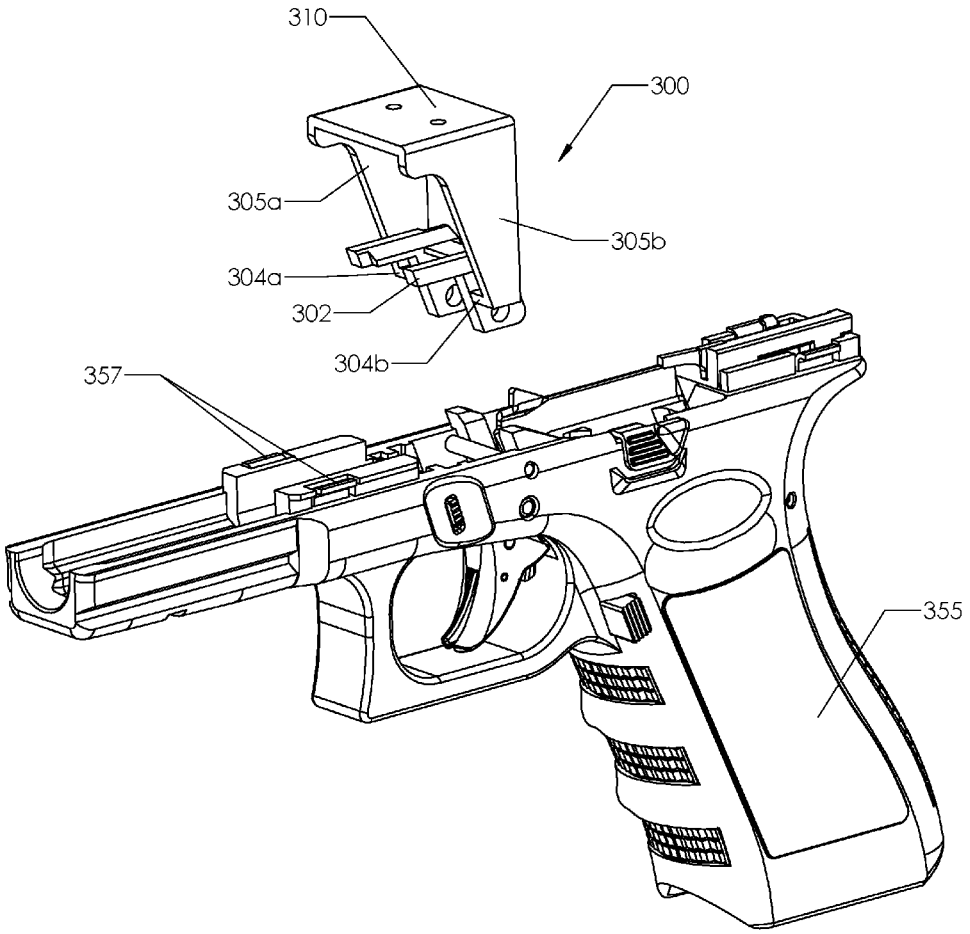
FIGS. 3A and 3B illustrate yet another example implementation of an integrated optical sight mount according to the principles of the present disclosure.
Figure 3B:
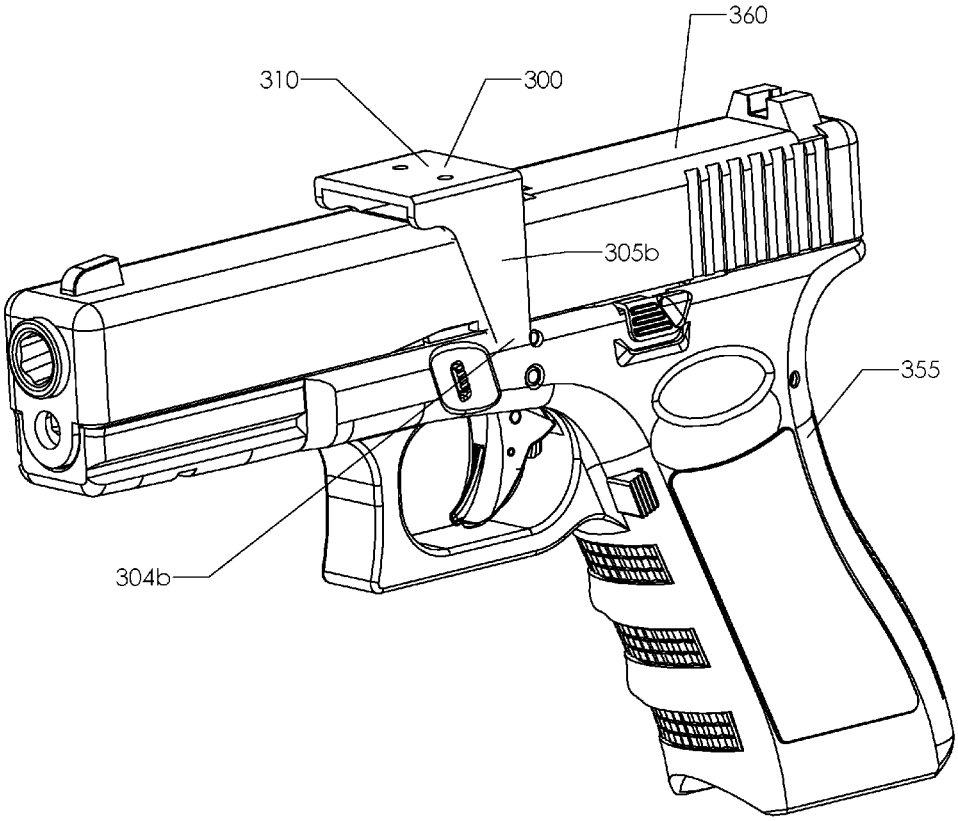

FIGS. 3A and 3B illustrate yet another example implementation of an integrated optical sight mount 300 in accordance with the present disclosure. In some implementations, the integrated optical sight mount 300 is similar to the integrated optical sight mount 100, 200 discussed above but further comprises an integral locking block 302. In this way, the optical sight mount 300 may be integrated into a handgun by installing the locking block 302 in the frame 355 thereof. In some implementations, the locking block 302 may be used to lock the barrel to the slide of a handgun. In this way, a loaded cartridge may be fired from a stable chamber. In some implementations, the locking block 302 may be similar to the locking block found in a Glock® handgun, which would be well known to one of ordinary skill in the art.

As shown in FIG. 3A, in some implementations, the integrated optical sight mount 300 may comprise a locking block 302, a first side wall 305*a* and a second side wall 305*b* (collectively side walls 305), and a mounting platform 310. In some implementations, the integrated optical sight mount 300 may be a single unitary piece (see, e.g., FIG. 3). In some implementations, the integrated optical sight mount 300 may not be a single unitary piece, for example, the mounting platform 310 may be removable from the side walls 305. In some implementations, the integrated optical sight mount 300 may be a drop in modification for an existing handgun.

As shown in FIG. 3A, in some implementations, a first horizontal extension 304*a* (not shown) and a second horizontal extension 304*b* may extend from opposite sides of the locking block 302. In some implementations, the first horizontal extension 304*a* and the second horizontal extension 304*b* connect the locking block 302 to the first side wall 305*a* and the second side wall 305*b*, respectively. In some implementations, when the locking block 302 is seated within the handgun frame 355, the first horizontal extension 304*a* and the second horizontal extension 304*b* are each positioned on the locking block 302 so that they extend through a gap between the slide assembly 360 and the frame 355 of an assembled handgun (see, e.g., FIG. 3B). In some implementations, when the locking block 302 is seated within the handgun frame 355, the first and second horizontal extensions 304*a*, 304*b* are positioned below a bottom side of the front guide rails 357. In this way, the horizontal extensions 304*a*, 304*b* of the integrated optical sight mount 300 do not interfere with the reciprocating movement of the handgun slide during normal operation.

FIGS. 4A-4E illustrate still yet another example implementation of an integrated optical sight mount 400 in accordance with the present disclosure. In some implementations, the integrated optical sight mount 400 is similar to the integrated optical sight mount 100 discussed above except that the first side wall 405*a* and the second side wall 405*b* are positioned adjacent to the first rear guide rail 459*a* and the second rear guide rail 459*b*, respectively, of the handgun frame 455. In this way, the integrated optical sight mount 400 positions the mounting platform 410 and the attached optical sight 30 over the rear end of the slide assembly 460 (see, e.g., FIGS. 4D and 4E).

In some implementations, a gap may extend between the interior side of the first side wall 405*a* and the first rear guide rail 459*a* and between the interior side of the second side wall 405*b* and the second rear guide rail 459*b*. In this way, the side walls 405 do not prevent the slide 462 from interfacing with, or sliding on, the rear guide rails 459*a*, 459*b* of the handgun frame 455 (see, e.g., FIG. 4D).

Figure 4A:
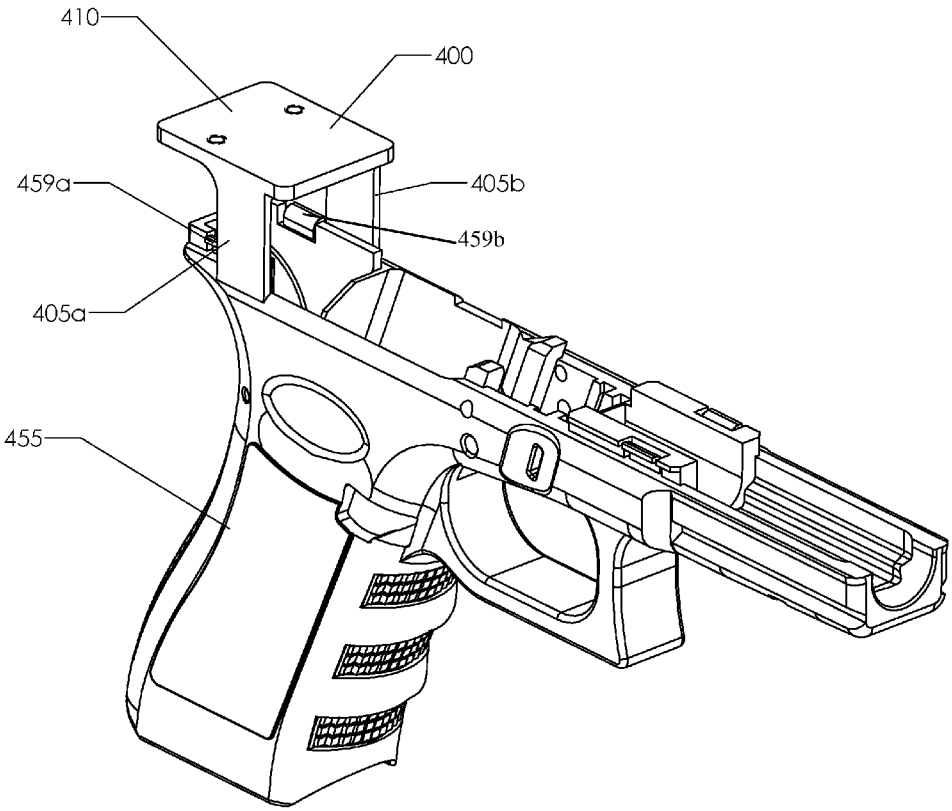
FIGS. 4A and 4B illustrate isometric views of another example implementation of an optical sight mount that has been integrated into the frame of a handgun according to the principles of the present disclosure.
Figure 4B:
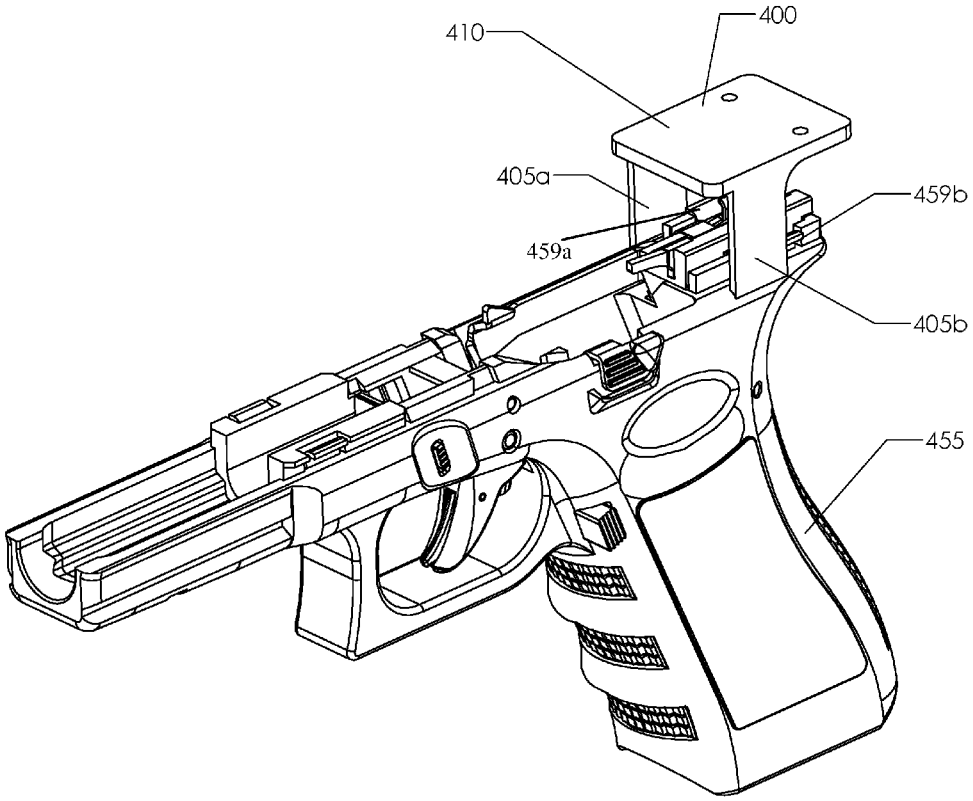
Figure 4C:
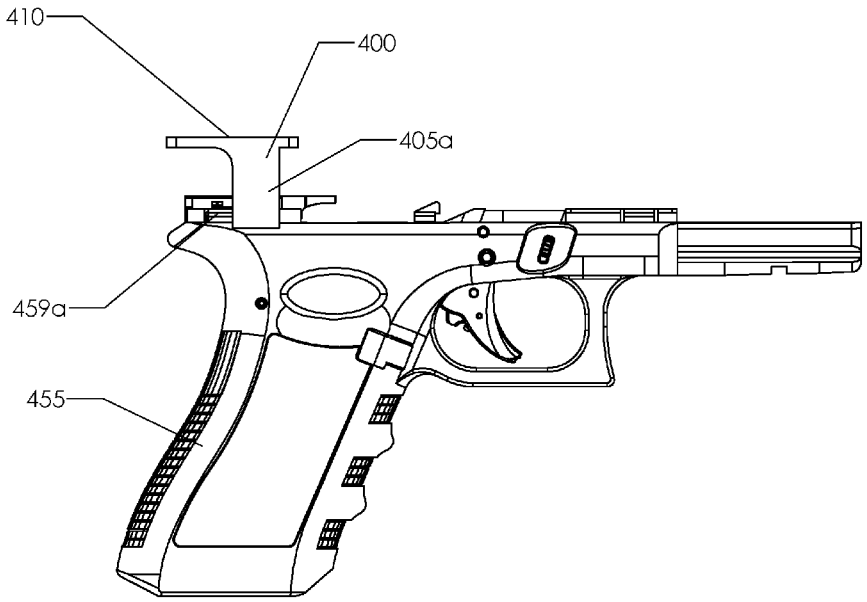
FIG. 4C illustrates a right side view of the integrated optical sight mount shown in FIG. 4A.
Figure 4D:
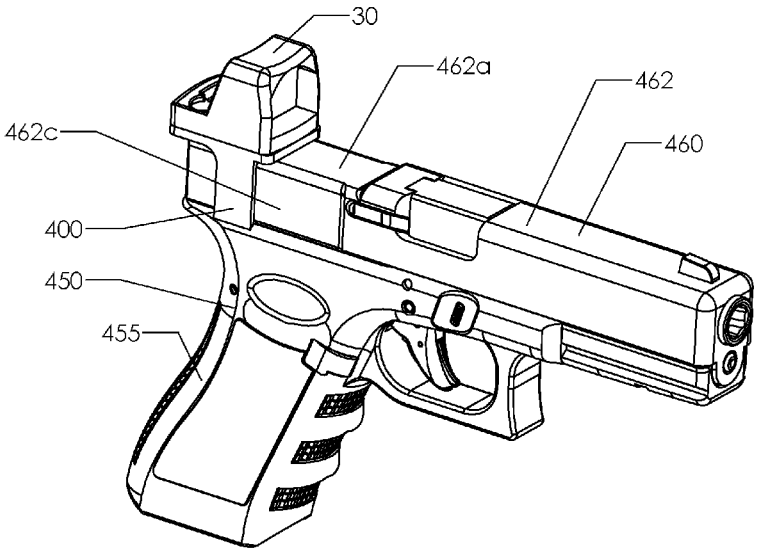
FIG. 4D illustrates an isometric view of the integrated optical sight mount shown in FIG. 4A, having a slide assembly and an optical sight installed thereon.
Figure 4E:
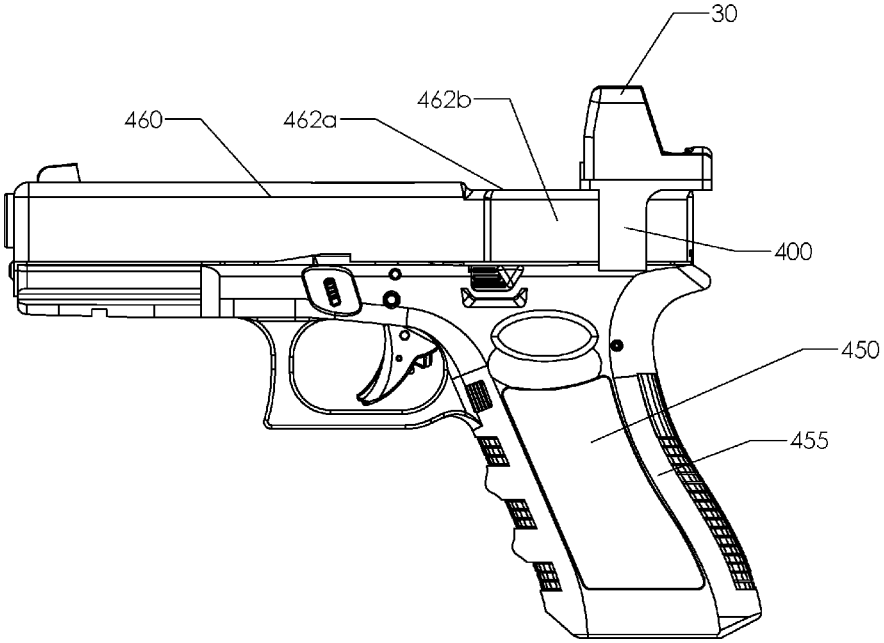
FIG. 4E illustrates a left side view of the integrated optical sight mount shown in FIG. 4D.

As shown in FIGS. 4D and 4E, in some implementations, the slide 462 may be machined or otherwise modified to remove a portion of the top side 462*a*, left side 462*b*, and/or right side 462*c* of the slide 462 that are adjacent the integrated optical sight mount 400. In this way, a mounting platform 410 and attached optical sight 30 may be placed closer to the top of the slide and thereby to the centerline of the bore without interfering with the reciprocating movement of the slide.

Figure 5A:
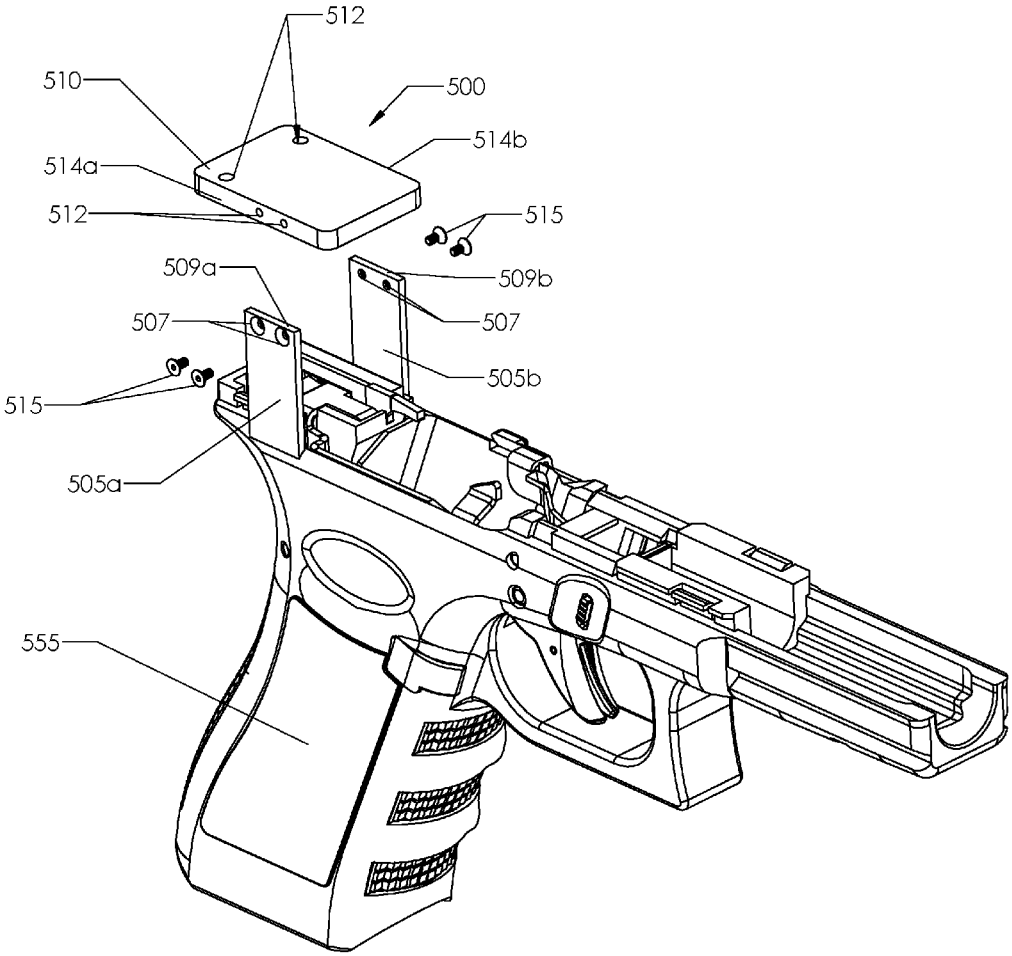
FIG. 5A illustrates an isometric view of yet another example optical sight mount that has been integrated into the frame of a handgun according to the principles of the present disclosure.
Figure 5B:
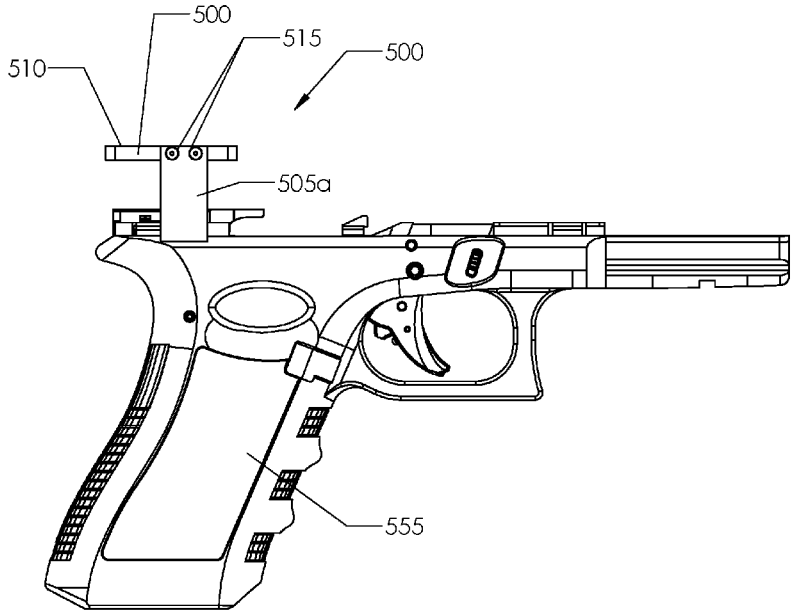
FIG. 5B illustrates a right side view of the integrated optical sight mount shown in FIG. 5A.

FIGS. 5A-5B illustrate yet another example implementation of an integrated optical sight mount 500 in accordance with the present disclosure. In some implementations, the integrated optical sight mount 500 is similar to the integrated optical sight mount 100, 400 discussed above but includes a removable mounting platform 510. Through the use of interchangeable mounting platforms 510 constructed to receive optical sights thereon, a user may change the optical sight mounted on the handgun frame 555 by changing mounting platforms 510. In this way, modification of the handgun is not required in order to accommodate a variety of optical sights.

As shown in FIG. 5A, in some implementations, the mounting platform 510 may be removably secured between the first side wall 505*a* and the second side wall 505*b* of the integrated optical sight mount 500.

In some implementations, as shown in FIG. 5A, there may be two openings 507 positioned adjacent the top side 509*a* of the first side wall 505*a* and the top side 509*b* of the second side wall 505*b*. Each of the openings 507 may be configured to receive a screw 515, or similar fastener, therein. In some implementations, each side wall 505*a*, 505*b* may include more than two or less than two openings 507 therethrough.

In some implementations, as shown in FIG. 5A, both a first side 514*a* and a second side 514*b* of the mounting platform 510 may include two openings 512 therein. In some implementations, each opening 512 is configured to threadedly receive a screw 515 therein. In some implementations, the first side 514*a* and the second side 514*b* of the mounting platform 510 may include more than two openings or less than two openings therein.

To assemble the integrated optical sight mount 500 constructed in accordance with the present disclosure, in some implementations, the openings 507 through the first side wall 505*a* and the second side wall 505*b* may be aligned with the openings 512 of the first side 514*a* and the second side 514*b*, respectively, of the mounting platform 510. Then, a screw 515 may be inserted through each opening 507 of a side wall 505 and threadedly secured into the aligned opening 512 of the mounting platform 510. Next, the user may secure an optical sight 30 of their choice to the mounting platform 510.

To disassemble the integrated optical sight mount 500, the above steps may be performed in reverse without the need to remove the optical sight 30 from the mounting platform 510.

The integrated optical sight mount 100, 200, 300, 400, 500 may be adapted to work with any autoloading pistol currently known or developed in the future (e.g., Glock® and/or Smith & Wesson® M&P® model handguns). In some implementations, the side walls 105, 205, 305, 405, 505 of an optical sight mount 100, 200, 300, 400, 500 may be molded into the frame of a handgun. While a Glock® model handgun is shown throughout the illustrations, it is to be understood that the optical sight mount 100, 200, 300, 400, 500 disclosed herein may be integrated into any suitable autoloading pistol.

In general, a user will want an optical sight 30 positioned as close to the centerline of the bore of their handgun as possible. In order to position an optical sight 30 as close to the centerline of the bore as possible, the integrated optical sight mount 100, 200, 300, 400, 500 may be configured to position the mounting platform as close to the slide as possible without interfering with its operation (e.g., longitudinal movements). In some implementations, the rear sight (see, e.g., element 66 of FIG. 1E) may have to be removed from the dove tail notch of the slide prior to the slide assembly being installed onto the frame of the handgun.

In some implementations, the integrated optical sight mount 100, 200, 300, 400, 500 may comprise a single side wall having a mounting platform extending therefrom (not shown). In some implementations, the single side wall may be configured to position the mounting platform over the slide of the handgun. In some implementations, the mounting platform may be removably secured to the single side wall by threaded fasteners.

In some implementations of the integrated optical sight mount 100, 200, 300, 400, 500, each side of the mounting platform may be supported by more than one side wall. In some implementations, a first side of the mounting platform may be supported by more side walls than the second side of the mounting platform, and vice versa.

In some implementations, an exterior side of the first and/or second side wall could be configured (e.g., include threaded openings therein) for an optical sight 30 to be mounted thereon. In this way, an optical sight 30 may be positioned at a 90 degree angle relative to the top side of the slide.

In some implementations, there may be a single side wall extending from the frame of the handgun. In some implementations, the single side wall may be configured for an optical sight to be secured on an interior side thereof. In this way, the optical sight may be positioned over the slide of the handgun.

In some implementations, an optical sight mount could be incorporated into the ejector block of a handgun. In this way, the optical sight mount may be integrated into the handgun by installing the ejector block in the frame thereof.

In some implementations, an integrated optical sight mount may be configured to provide power to an attached optical sight. In some implementations, the integrated optical sight mount may include a power source thereon.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A handgun having an integrated optical sight mount, the optical sight mount comprising:

a locking block configured to be installed in a frame of the handgun, the locking block is configured to lock a barrel to a slide of the handgun;

a first side wall and a second side wall that extend from the locking block, the first side wall extends from a first side of the locking block and the second side wall extends from a second side of the locking block; and a mounting platform that extends between the first side wall and the second side wall, the mounting platform is configured for an optical sight to be secured thereon;

wherein the mounting platform and the side walls define an opening therebetween, the opening is configured so that a slide assembly of the handgun is able to pass therethrough.

2. The optical sight mount of claim 1, wherein the locking block further comprise a first horizontal extension extending from a first side and a second horizontal extension extending from a second side, the first side wall and the second side wall extend from the first horizontal extension and the second horizontal extension, respectively.

3. The optical sight mount of claim 2, wherein the mounting platform is removably secured between the first side wall and the second side wall by threaded fasteners.

4. The optical sight mount of claim 2, wherein the first side wall and the second side wall are parallel to each other.

* * * * *